United States Patent [19]

Kooy

[11] Patent Number: 4,608,835

[45] Date of Patent: Sep. 2, 1986

[54] CABINET FOR COOLING GOODS, ETC.

[76] Inventor: Hermen Kooy, P.O. Box 306, NL-1430 AH Aalsmeer, Netherlands

[21] Appl. No.: 740,309

[22] Filed: Jun. 3, 1985

Related U.S. Application Data

[63] Continuation of Ser. No. 598,007, Apr. 9, 1984, abandoned.

[30] Foreign Application Priority Data

Nov. 2, 1983 [NL] Netherlands ..... 8303771
Feb. 20, 1984 [NL] Netherlands ..... 8400536

[51] Int. Cl.[4] ..... A47F 3/04
[52] U.S. Cl. ..... 62/255; 62/256; 62/277; 62/281
[58] Field of Search ..... 62/281, 315, 316, 277, 62/255, 256; 312/116

[56] References Cited

U.S. PATENT DOCUMENTS

| | | | |
|---|---|---|---|
| 2,001,309 | 5/1935 | Kelly | 62/281 |
| 2,279,484 | 4/1942 | Munshower | 62/256 X |
| 2,669,850 | 2/1954 | Bishop | 62/281 X |
| 2,920,459 | 1/1960 | Ladusaw | 62/281 |
| 3,203,197 | 8/1965 | Zaslovsky et al. | 62/277 |
| 3,218,822 | 11/1965 | Bently et al. | 62/255 X |
| 3,593,538 | 7/1971 | Bachman | 62/256 |
| 3,651,660 | 3/1972 | Quiros | 62/281 X |
| 3,696,630 | 10/1972 | Bressickello | 62/256 X |
| 4,458,501 | 7/1984 | Kooy | 62/256 |

*Primary Examiner*—Lloyd L. King
*Attorney, Agent, or Firm*—John P. Snyder

[57] ABSTRACT

A cabinet for cooling goods, e.g., flowers having a cooling system and an open space for freely exhibiting goods such as cut-flowers, a large amount of air is cooled, so that much moisture is set free. The invention provides a solution for a simple evacuation of the moisture by providing absorption means absorbing said moisture.

22 Claims, 3 Drawing Figures

Figure 1:
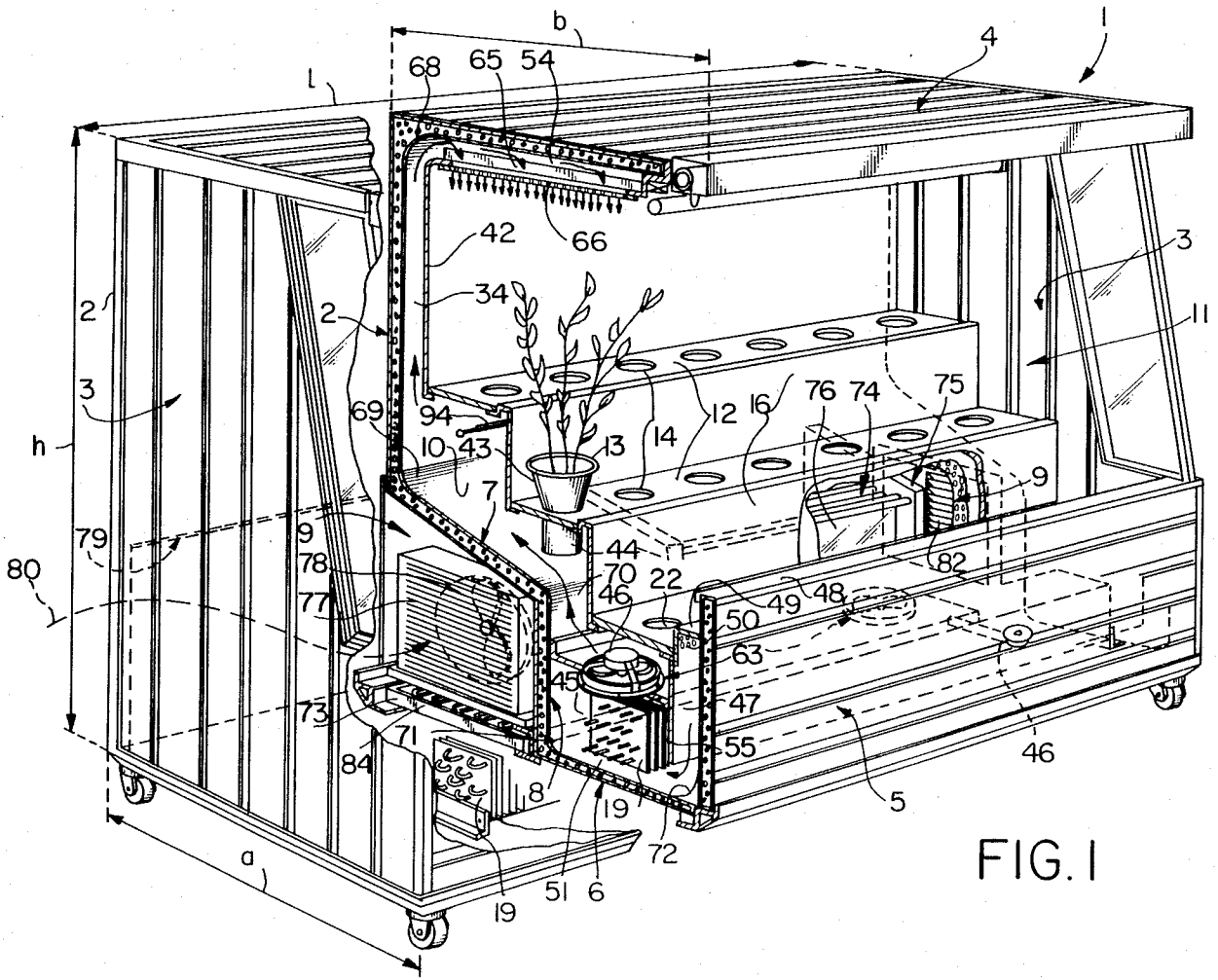

CABINET FOR COOLING GOODS, ETC.

This application is a continuation, of application Ser. No. 598,007, filed Apr. 9, 1984, now abandoned.

The invention relates to a cabinet for cooling goods e.g. flowers having a cooling system comprising a moisture collecting trough.

In a cabinet having an open space for freely exhibiting goods such as cut-flowers, a large amount of air is cooled, so that much moisture is set free, which has to be conducted away to a sewer or otherwise.

The invention provides a solution for a simple evacuation of the moisture. The inventive steps concerned are defined in the claims and will be explained in the following description of a preferred embodiment of a cabinet in accordance with the invention, which is schematically shown in the drawing.

The drawing shows in

Figure 2:
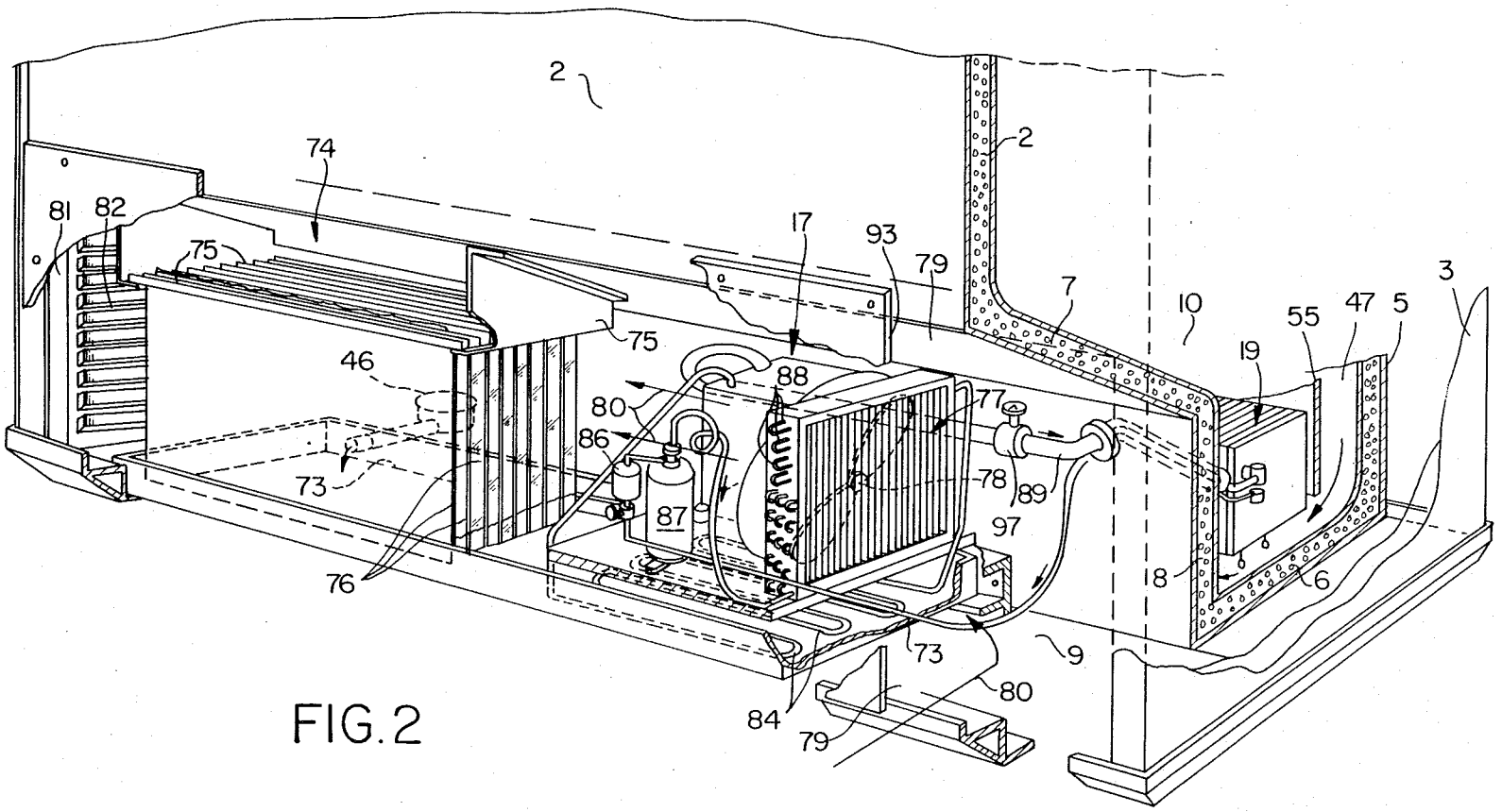

FIG. 1 a perspective, fragmentary front view,

FIG. 2 a perspective, fragmentary rear view and

Figure 3:
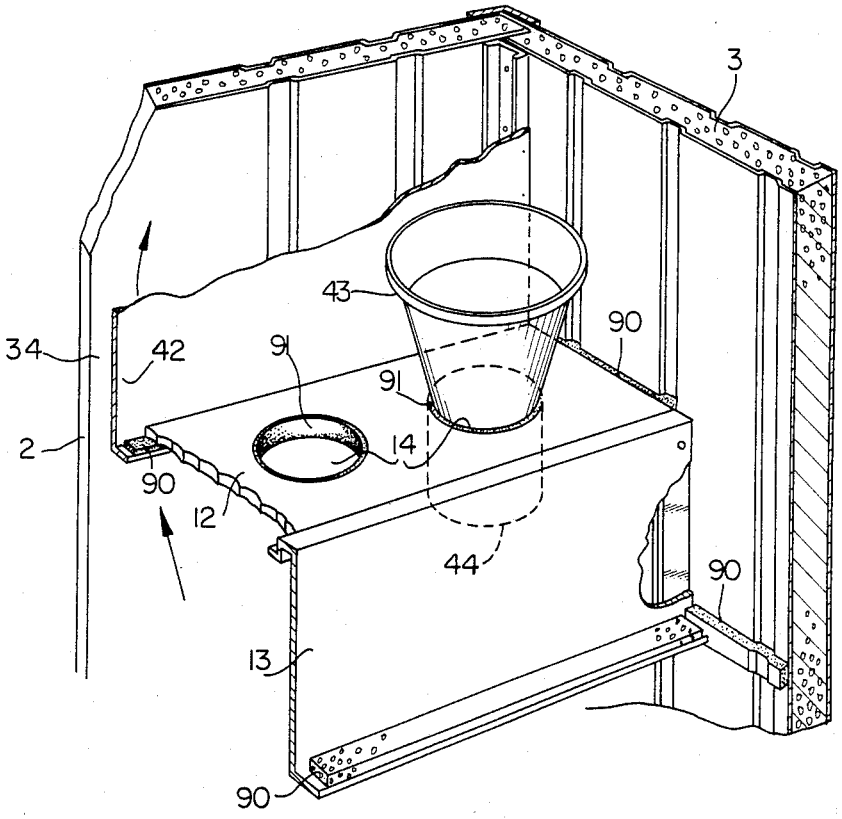

FIG. 3 a perspective, fragmentary view of detail of FIG. 1.

The cabinet comprises insulating walls i.e. a rear wall 2, side walls 3, a top wall 4, a front wall 5, a bottom wall 6 and intermediate walls 7 and 8. The intermediate walls 7 and 8 separate a moisture treating space 9 from a cooling space 10. The cooling space 10 is separated from a flower space 11 by means of a sequence of tables 12 and adjoining, vertical partitions 16 arranged between the former. The horizontal tables 12 are disposed amphitheatrically. The tables 12 having openings 14 for receiving flower-boxes 13, which extend through the openings as far as into the cooling space 10. The flower-boxes preferably have each a conical top end 43 and a cylindrical bottom end 44 extending over a large part of the height into the cooling space 10. An evaporator 19 is arranged in an evaporation space 45 covering substantially the whole length of the cabinet 1 and being separated from the cooling space 10 by a horizontal wall 46 having air passing means formed by two ventilators 63 distributed along the length of the cabinet 1, whilst the lower part 51 of the evaporation space 45 communicates with the flower space through an air channel 47 located in front of said space.

The channel 47 extends throughout the length of the cabinet between the front wall 5 and the evaporation space 45 and comprises at a lower level than the top edge 48 of the front wall 5 a grating 22 having a horizontal part 49 and a vertical part 50. The air sucked in and thus cooled by the ventilators 63 through the evaporation space 45 passes through the cooling space 10, strongly cools the boxes 13 and then flows through a channel 34 bounded between the rear wall 2 and a rear partition 42 towards a compressed air space 54, which is bounded by the insulated top wall 4 and a layer of filtering material 65 arranged between the compressed air chamber 54 and an air inlet formed by a grating 66, which covers substantially the whole length and practically the whole width of the top wall 4. Thus the air is distributed along the entire surface of the top wall 4 and passed into the flower space 11 in the form of a very slowly dropping stream.

This has the advantage that the homogeneous, hardly whirling downstream mixes only to a minor extent with the atmospheric air outside the space 11.

Therefore, this downstream of air remains dry and during the cooling process little moisture need to be removed from the air.

A further advantage is that the flowers are less affected by the low rate of the air. The flowers retain the air and hence the cold between them, which is very advantageous in itself.

The small rate of cold air is just sufficient to keep the flower space cool without the flower heads being brushed by an impermissibly cold air stream. The flower space is bounded by insulated walls 2, 3 and 4 and the tables 12 with partitions 16 and furthermore by glass plates 37, whilst the front side is open, so that the flowers are quite visible and readily accessible. In order to close the flower space 11 at night a roller cloth 38 serves to cover the front side in the position indicated by broken lines. Furthermore a lighting system is provided in the top wall 4.

The external distance a between the front side 52 and the rear side 53 of the cabinet 1 is less than 90 cms and preferably about 85 cms. The 85 cms distance is a size which permits of disposing the cabinet at the side of other racks along a foot path of a sales room. The length l of the cabinet is, for example, 2 meters.

On the top side the cabinet 1 has a depth b of, for example, 62 cms or of that order of magnitude. The height h above the moisture collecting space 9 may be 123 cms or of that order of magnitude. The maximum internal depth d of the flower space may be 67 cms or of that order of magnitude.

The cold air stream is indicated by arrows 55.

The pressure of the compressed air chamber 54 exceeding the atmospheric pressure is obtained by using filter material or another porous material ensuring a uniform air distribution across the top surface. In order to avoid whirling the flow channel 34 adjoins the compressed air chamber 54 by a rounded-off corner 68, whilst also the corners 69, 70, 71 and 72 for adjouning the rear wall 2, the intermediate walls 7 and 8, the bottom 6 and the front wall 5 are rounded off.

In order to maintain the air pressure exceeding the atmospheric pressure in the cooling space 10, the channel 34 and the compressed air chamber 54, the flower space at the tables 12 is closed by means of sealing strips 71 against the cooling space 10. Further sealing strips 72 are provided at the edges of the recesses 14.

The moisture condensing in the evaporations space 45 is conducted away through draining means 46 leading down to a moisture collecting trough 73. Above the moisture collecting trough 73 are provided moisture absorbing means 74 formed by a plurality of strips 76 of moisture absorbing material, for example, blotting paper suspended parallel to the direction of length of the cabinet 1 to suspension means 75, the lower edges of said strips extending as far as into the moisture collecting trough 73.

The moisture cooling space 9 furthermore comprises a radiator 77 with a ventilator 78, which blows atmospheric air from an air inlet space 79 in the direction of length of the cabinet 1 in the direction of the arrows 80 through the radiator, along a compressor aggregate 17, then between the strips 76 and finally through an air grating 82 in the sidewall 81 to the outside.

The Freon gas heated in the evaporator 19 is fed through a duct 83, a choke 96, a filter 86 and a buffer vessel 87 to a pipe system 88 of the radiator 77, where heat is extracted from the Freon gas and the air passed through the radiator 77 is heated.

The pipe system 88 is connected with a pipe system 84 arranged in the moisture collecting trough 73, so that the moisture in the collecting trough 73 is heated and the Freon gas is slightly cooled. The pipe system 84 is connected with a compressor aggregate 17 in which the Freon gas is compressed and gives off heat to the compressor aggregate 17, which is cooled by the air stream. From the compressor aggregate 17 the Freon gas is conducted towards the evaporator 19 through an insulated duct 89 and a cock 97. The air stream further heated by the compressor aggregate 17 is then capable of absorbing much moisture from the strips 76.

Experiments have shown that in this way all moisture can be removed from the moisture collecting trough 73. The air inlet space 79 communictes through an opening 93 or a grating on the rear side of the cabinet 1 with the atmosphere. The cooling system can be actuated when a value set in a thermostat 94 of the temperature in the cooling space 10 is exceeded. The thermostat 94 may, as an alternative, be arranged in the flower space 11. The thermostat 94 can atuate the compressor aggregate 17 and hence at the same time the ventilator 78. It is also conceivable to actuate the cooling system periodically by a time switch with set time constant. The ventilators 63 can operate continuously.

The elements arranged in the moisture treating space 9 and their relative disposition may be used not only in a cabinet 1 for cut-flowers, but also in a cabinet for dairy produce or other goods, which cabinet is open at the front and hence readily accessible for taking out the exhibited products.

What I claim is:

1. A showcase for refrigerated goods and which is of sufficiently little front to rear depth as to allow placement at the side of an aisle, which comprises:

an insulated wall having a vertically extending front wall portion terminating in an upper edge, a horizontally extending bottom wall portion projecting rearwardly from said front wall portion, a vertically extending first intermediate wall portion projecting upwardly from said bottom wall portion in rearwardly spaced relation to said front wall portion, a second intermediate wall portion extending rearwardly from said first intermediate wall portion adjacent the upper portion thereof, a rear wall portion extending upwardly from said second intermediate wall portion, a top wall portion extending forwardly from said rear wall portion and terminating in a forward edge, and side wall portions at the two sides of the showcase, each side wall portion having a front edge substantially commensurate with the height of said front wall portion and extending therefrom to the rear of the showcase with a height extending from said bottom wall portion to said top wall portion and defining in combination with the other wall portions an enclosure having an open front defined between said upper edge and said front edge through which goods may be viewed and made accessible to a potential purchaser;

a stepped platform assembly extending from generally adjacent said upper edge of the front wall portion to a region spaced forwardly from said rear wall portion, a rear partition extending upwardly from said platform assembly in closely spaced relation to said rear wall portion to define a channel therebetween leading upwardly from the space between said wall portions and said assembly, and air permeable means underlying said top wall portion and communicating with said channel for distributing air downwardly into said enclosure;

a refrigerant evaporator disposed above said bottom wall portion and extending substantially from one side wall portion to the other side wall portion, drain means passing through said frist intermediate wall portion to drain condensate caused by cooling due to said evaporator to pass through such intermediate wall portion to a point behind it, there being air inlet means adjacent said upper edge for admitting air from above said platform assembly into said space, and fan means for forcing air through said air inlet means past said evaporator and into said space to flow through said channel and said air permeable means;

a condensate tray disposed behind said first intermediate wall portion and into which said drain means discharges, said showcase having a rear closure wall extending downwardly from said rear wall portion and defining with said insulated wall portions an air tunnel extending end-to-end generally from one side wall portion to the other side wall portion and nested beneath the second intermediate wall portion which overlies it, said tunnel having ambient air inlet means adjacent one end thereof and moisture laden air outlet means adjacent the other end thereof;

a refrigerant condenser disposed above said tray adjacent said one end of the tunnel so that ambient air may pass thereover, fan means for inducting air into said air inlet means and causing it to flow through said tunnel and thence outwardly through said air outlet means, a refrigerant compressor disposed within said tunnel downstream of said condenser, and water absorbent means downstream of said compressor for absorbing condensate from said tray and exposing it for evaporation both in the lateral and the vertical directions of said tunnel.

2. A showcase as defined in claim 1 including refrigerant lines connecting said compressor to said evaporator, said evaporator to said condenser and said condenser to said compressor, at least a portion of a refrigerant line from said evaporator to said condenser lying in said condensate tray to heat condensate therein.

3. A showcase as defined in claim 2 wherein said water absorbent means comprises a plurality of laterally spaced sheets of absorbent material suspended from said second intermediate wall portion, said sheets defining a multichannel air passage within said tunnel.

4. A showcase as defined in claim 1 wherein said water absorbent means comprises a plurality of laterally spaced sheets of absorbent material suspended from said second intermediate wall portion, said sheets defining a multichannel air passage within said tunnel.

5. A showcase as defined in claim 1 wherein said stepped assembly includes platforms having openings therein to receive the bottom portions of cut flower pots, said second intermediate wall portion sloping upwardly similar to the rise of said stepped assembly, said air permeable means being sufficiently resistant to flow of air therethrough as to create a positive pressure within said space while bleeding cooled air gently downwardly into said enclosure.

6. A showcase as defined in claim 2 wherein said stepped assembly includes platforms having openings therein to receive the bottom portions of cut flower pots, said second intermediate wall portion sloping upwardly similar to the rise of said stepped assembly, said air permeable means being sufficiently resistant to flow of air therethrough as to create a positive pressure within said space while bleeding cooled air gently downwardly into said enclosure.

7. A showcase as defined in claim 3 wherein said stepped assembly includes platforms having openings thereinto receive the bottom portions of cut flower pots, said second interemdiate wall portion sloping upwardly similar to the rise of said stepped assembly, said air permeable means being sufficiently resistant to flow of air therethrough as to create a positive pressure within said space while bleeding cooled air gently downwardly into said enclosure.

8. A showcase as defined in claim 4 wherein said stepped assembly includes platforms having openings therein to receive the bottom portions of cut flower pots, said second intermediate wall portion sloping upwardly similar to the rise of said stepped assembly, said air permeable means being sufficiently resistant to flow of air therethrough as to create a positive pressure within said space while bleeding cooled air gently downwardly into said enclosure.

9. A showcase for refrigerated goods which comprises a cabinet having an open front portion through which goods may be viewed and are made accessible to a potential purchaser; first partition means defining said open front portion; second partition means cooperating with said first partition means to define a cooling space communicating with said open front portion; refrigerant evaporator means in said cooling space; fan means for withdrawing air from said open front portion into said cooling space, passing it over said evaporator means and reintroducing it into said open front portion; said second partition means also providing a compressor/evaporator space within said cabinet which is isolated from said open front portion and said cooling space; an elongate condensate tray within said compressor/evaporator space; drain means for directing condensate from said cooling space into said condensate tray; a condenser disposed above and adjacent one end of said condensate tray; water absorbing means extending lengthwise of said condensate tray toward the other end thereof but spaced from said condenser for absorbing condensate from said tray and providing a multichannel air passage; a compressor disposed above said tray between said condenser and said water absorbing means; and second fan means for directing ambient air through said condensor, over said compressor and through said multichannel air passage to the exterior of said cabinet.

10. A showcase as defined in claim 9 including a length of refrigerant line conveying refrigerant from said condenser to said compressor is disposed within said tray to heat condensate therein.

11. A cabinet for cooling flowers comprising the combination of:

a pair of side walls, a rear wall, a top wall and table means extending between said side walls and forwardly from said rear wall in spaced, underlying relation to said top wall for defining an open front flower cooling space within which flowers are placed to be cooled while on display;

means for cooling air to be supplied to said cooling space and defining a cooling air chamber;

said top wall including air flow resistance means communicating with said cooling air chamber for impeding the flow of cooling air therethrough while distributing air downwardly substantially uniformly throughout the area of said top wall; and air flow means communicating with said cooling air chamber for supplying cooling air under superatmospheric pressure to said air flow resistance means so that the cooling air is distributed gently downwardly into said flower cooling space to protect the flowers from premature degradation which would result from strong drafts of cooling air directed upon them.

12. A cabinet as defined in claim 11 wherein said air flow resistance means is formed of a layer of air permeable material.

13. A cabinet as defined in claim 11 wherein said table means is provided with openings therethrough and including a flower box recieved in each of said openings and projecting downwardly therethrough, said table means together with said flower boxes separating said flower cooling space from said cooling air chamber so that the downwardly projecting portions of the flower boxes are exposed directly to the atmosphere of said cooling air chamber.

14. A cabinet as defined in claim 11 wherein said cabinet includes an evaporation space and a horizontal wall separating said cooling air chamber from said evaporation space, said horizontal wall having a series of openings therein distributed between said side walls, evaporator means in said evaporation space, and said air flow means directing return air fromsaid flower space through said cooling air chamber and through said series of openings before passing to said air flow resistance means.

15. A cabinet as defined in claim 14 including further wall means providing a moisture treating space behind said evaporation space, and compressor means disposed in said moisture treating space.

16. A cabinet as defined in claim 15 wherein condensor means is also disposed in said moisture treating space.

17. A cabinet as defined in claim 16 including fan means for directing ambient air through said moisture treating space, said moisture treating space including a longitudinally extending section and a plurality of sheets of moisture absorbing material forming a multichannel ambient air flow passage through said section, and means for directing moisture from said evaporation space to said sheets.

18. A showcase for refrigerated goods comprising a display case having a front wall, a rear wall, a top wall and opposite side walls, said front wall providing an open upper portion through which visual and physical access to displayed goods may be had;

said display case having a support portion below said top wall and extending from adjacent the lower part of said open upper portion upwardly and rearwardly therefrom;

partition means for defining a cooling space below said support portion in communication with said lower part of said open upper portion and which cooling space extends generally between said opposite side walls, for defining an air channel generally between said opposite side walls and leading from said cooling space upwardly behind said support portion and terminating in means for bleeding cooled air downwardly below said top wall into said access space in substantially uniformly distributed fashion between said opposite side walls so that the cooled air bled into the open upper portion flows gently downwardly to encounter said support portion and ultimately back to said cooling space through the communication therewith at said lower part, and for defining an air tunnel extending generally between said opposite side walls behind said cooling space;

refrigerant evaporator means disposed in said cooling space for cooling air passing thereover;

first fan means for introducing air into said cooling space and passing it over said evaporator means to flow under pressure through said air channel to bleed through said means for bleeding air into said open upper portion;

second fan means for passing ambient air from outside said case through said air tunnel and outwardly of said case;

condenser means in said air tunnel for condensing refrigerant;

refrigerant pumping means for pumping refrigerant through said evaporator means and said condenser means;

condensate tray means in said air tunnel for collecting condensate from said cooling space; and water absobent means for absorbing condensate from said tray means and exposing it to evaporation in both the lateral and the vertical directions of said air tunnel.

19. A showcase for refrigerated goods as defined in claim 18 wherein said water absorbent means comprises a plurality of sheets of absorbent material upstanding from said tray means and extending along a portion of the length of the air tunnel to separate said portion of the length of the air tunnel into a plurality of air channels through which said ambient air is passed to evaporate said condensate.

20. A showcase for refrigerated goods comprising a display case defining an enclosure divided into a plurality of separate compartments, one of said compartments being a display compartment located at the top front of said case and extending substantially the width of the display case and within which goods are displayed, a second of said compartments being a cooling compartment below said display compartment and extending substantially the width of the display case, a third of said compartments being an air channel behind said display compartment and extending substantially the width of the display case and extending from said cooling compartment to a region overhanging said display compartment, and a fourth of said compartments being an air tunnel extending substantially the width of the display case in the rear thereof;

evaporator means within said cooling compartment for cooling air therewithin;

fan means for passing air under pressure from said cooling compartment into said air channel;

condenser means within said air tunnel for condensing refrigerant from said evaporator means;

water absobent means in said air tunnel for absorbing condensate from said evaporator means;

and second fan means for inducting ambient air into said air tunnel to pass over said condenser means and past said water absorbent means and the outwardly from said air tunnel.

21. A showcase as defined in claim 20 including condensate collecting means in said air tunnel for collecting condensate from said cooling space, said water absorbent means absorbing condensate from said condensate collecting means.

22. A showcase as defined in claim 21 wherein said water absobent means comprises a plurality of sheets of absorbent material upstanding from said condensate collecting means and separating a length of said air tunnel into a series of upstanding air channels.

* * * * *